United States Patent [19]

Berman et al.

[11] 4,344,262

[45] Aug. 17, 1982

[54] LONG SPAN STRUCTURAL FRAME

[76] Inventors: Herbert M. Berman, 300 E. 74th St., New York, N.Y. 10021; Ira Hooper, 510 E. 23rd St., New York, N.Y. 10010

[21] Appl. No.: 713,804

[22] Filed: Aug. 12, 1976

Related U.S. Application Data

[63] Continuation of Ser. No. 313,490, Dec. 8, 1972, abandoned.

[51] Int. Cl.[3] ..... E04C 3/02

[52] U.S. Cl. ..... 52/227; 52/252; 52/263

[58] Field of Search ..... 52/250, 252, 650, 334, 52/227, 646, 655, 263

[56] References Cited

U.S. PATENT DOCUMENTS

| | | | |
|---|---|---|---|
| 948,215 | 2/1910 | Fitzpatrick | 52/227 |
| 976,182 | 11/1910 | Jones | 52/252 |
| 1,045,522 | 11/1912 | Conzelman | 52/236 |
| 1,380,324 | 5/1921 | Piggins | 52/334 |
| 1,446,275 | 2/1923 | Schulze | 52/250 |
| 2,115,949 | 3/1938 | Gurber | 52/236 |
| 2,329,068 | 9/1943 | Mackintosh | 52/650 |
| 3,890,750 | 6/1975 | Berman et al. | 52/250 |

FOREIGN PATENT DOCUMENTS

| | | | |
|---|---|---|---|
| 647330 | 12/1950 | United Kingdom | 52/646 |

*Primary Examiner*—James L. Ridgill
*Attorney, Agent, or Firm*—Thomas R. Boland

[57] ABSTRACT

A building construction comprising spaced parallel structural members, such as rolled steel beams and girders, forming a plurality of horizontally disposed structural bays in which the compression flanges of the girders are restrained against lateral displacement or buckling under compressive loads by concrete joists having notched end portions, especially during construction and prior to hardening of concrete poured thereover to form floor slabs. The joists are supported by, and extend transversely between, the girders. Adjacent end portions of the joists are connected to each other to form continuous lines of tension or compression ties at selected intervals along the girders. In a preferred embodiment, the continuous ties terminate at horizontal trusses formed at the end of a row of bays by at least one diagonally disposed truss member, such as a cable.

4 Claims, 4 Drawing Figures

LONG SPAN STRUCTURAL FRAME

This is a continuation, of application Ser. No. 313,490 filed Dec. 8, 1972, now abandoned.

BACKGROUND OF THE INVENTION

This invention relates to a building construction having a frame structure including girders which are secured against lateral displacement and buckling especially prior to the hardening of the concrete floor slabs.

In one type of building construction, concrete flooring utilizing pre-cast concrete joists are erected on the tops of pre-cast concrete girders attached to vertical concrete columns and thereafter sheets of plywood or other concrete forming materials are supported between the joists to act as forms on which wet concrete is placed. When the concrete has hardened, the forms are removed to expose a completed concrete structure. While such a structure may be practical for short-span construction, in long-span construction the excessive weight of the concrete girders and the resulting difficulty in their transportation and erection makes their use costly. One alternative is, of course, the use of steel girders; but these were not employed in the past in connection with concrete joists because of the inability of those joists to restrain the girders from buckling during construction and before hardening of the concrete slabs. When the slabs have hardened, they form a stiff horizontal diaphragm that prevents lateral displacement of the girder compression flanges. However, when wet and uncured, neither the concrete slabs nor concrete joists have the capability of preventing such lateral displacement.

SUMMARY OF THE INVENTION

Thus, it is an initial object of this invention to provide a practical means of using pre-cast concrete joists in conjunction with structural steel girders.

It is another general object of this invention to provide a lateral bracing system to prevent displacement or buckling of compression flanges of steel girders.

It is another object of the invention to provide a structure in which pre-cast, notched concrete joists are tied together over the compression flanges of steel girders to form a continuous line of tension or compression ties to restrain the girders against buckling.

It is yet another object of this invention to provide a structure in which pre-cast, notched concrete joists are ties together over the compression flanges of steel girders to form a continuous line of joists terminating at horizontal truss sections to restrain the girders against buckling in either direction.

It is an additional object of this invention to provide a plurality of bays as generally described in a plan array for use in a building construction.

In accordance with the present invention, a building structure comprises a plurality of horizontally disposed structural members, such as rolled steel girders and beams which are secured to vertical columns to form a plurality of frames and bays and a plurality of end notched pre-cast concrete joists supported by and transversely extending between girders to provide lateral stability therefor. In a preferred embodiment at least one truss member extends diagonally across each of the bays at the end of the building to form horizontal trusses and the continuous tension or compression ties terminate in the trusses. Adjacent end portions of the joists are connected to each other to form continuous tension or compression ties at selected intervals along the structural members. The action of the joists and in particular the combined action of the secured joists and truss members substantially prevents any lateral displacement or buckling of the long-span girders under construction loads. When the joists are in place, forms are suspended therebetween into which concrete is placed to produce a composite structure.

DETAILED DESCRIPTION OF THE PREFERRED EMBODIMENTS

Figure 1:
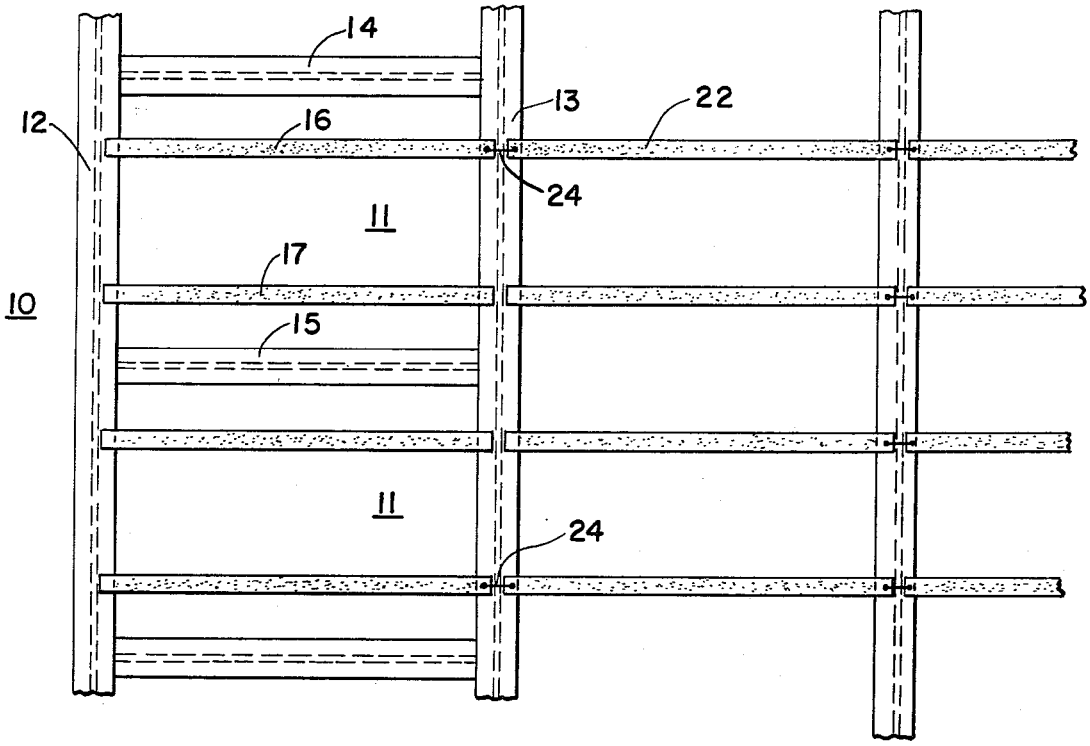
FIG. 1 is a diagrammatic plan view of a representative portion of a building skeleton according to this invention.

Referring now to the drawing and initially to FIG. 1 thereof, a representative portion at one end of a long-span building construction is designated generally by the reference numeral 10. The construction 10 includes a series of bays each of which is designated generally by the reference numeral 11. These bays are located at one end of a larger floor complex the size of which will be determined by the requirements of the installation. The bay unit 11 comprises a pair of generally horizontally disposed spaced, parallel girders 12 and 13 and a pair of spaced beams 14 and 15 extending transversely between the girders and connected thereto.

The girders 12 and 13 are secured to base supports or columns (not shown) in a manner well-known to the art, and may be of any conventional structural element, such as the rolled-steel I-beams shown in FIG. 1.

Figure 2:
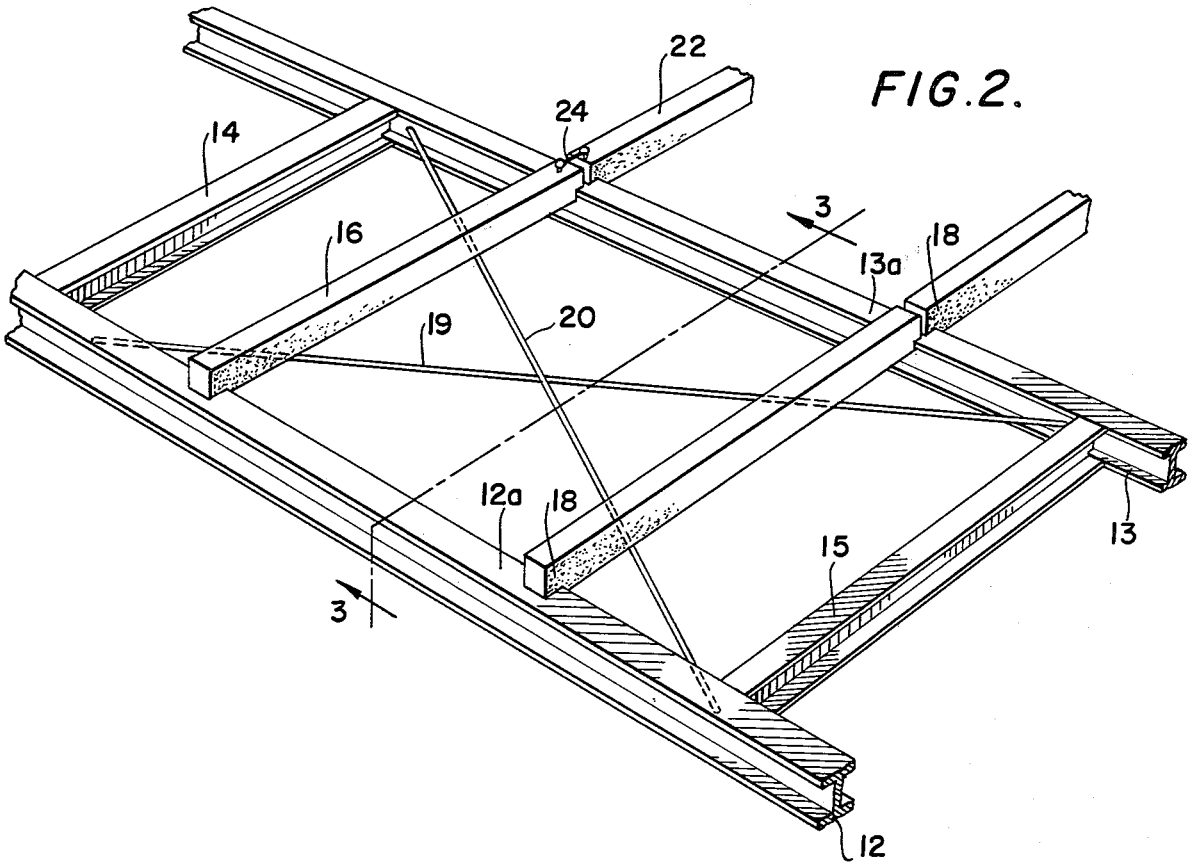
FIG. 2 is a perspective view of a representative portion of a building construction according to this invention showing the connection of the notched concrete joists over the compression flanges of the girders.

Extending transversely to the girders 12 and 13 are pre-cast concrete joists 16 and 17 which, as shown more clearly in FIG. 2, are notched at each end to form shoulder portions 18 which fit securely over the compression flanges **12*a* and 13*a* of the girders 12 and 13** respectively.

An end portion of joist 16 is connected to an adjacent notched pre-cast joist 22 at a common bearing point on the girder 13 by tie unit 24. This tying of joists is repeated across the structure so as to form continuous tension or compression ties. Of course, it is not necessary to tie every line of joists across the structure in this fashion since the formation of the ties at selected intervals will provide sufficient bracing to effect the desired restraint against lateral displacement and buckling. Also, instead of using tie units to form continuous lines of the joists across the structure, metal plates embedded in the ends of concrete joists may be welded to the metal flanges of the girders.

In a preferred embodiment, the tension or compression ties terminate in the bays 11 each of which is formed into a horizontal truss, such as illustrated in FIG. 2, in which a pair of truss members, preferably in the form of crossed cables 19 and 20, extend diagonally across each bay 11 and are connected to the girders 12 and 13. As better shown in FIG. 3, the distal ends of the cables 19 and 20 are connected to the web portions 12*b* and 13*b* of the girders 12 and 13, respectively, at points approximately vertically aligned with the intersection with the beams 14 and 15. These connections may be fittings 21 as shown, such that the cables 19 and 20 are quickly detachable from the girders 12 and 13 or they may be permanent such as by weldment. After connection in accordance with either of the foregoing methods, the cables 19 and 20 may then be tensioned in a conventional manner. The cables 19 and 20 may be of a conventional design such as cast one piece, rods, bars, or structured shapes such as angles or ties.

It is understood that the cables 19 and 20 may also be secured to either flange of the girders 12 and 13 in the above manner, or they may span from an upper flange to a lower flange or adjacent girders if desired.

The cables 19 and 20 are positioned generally lower than the joists 14 and 15 so that concrete construction forms (not shown), such as plywood sheets of conventional dimensions, may be positioned intermediate the frame.

Figure 4:
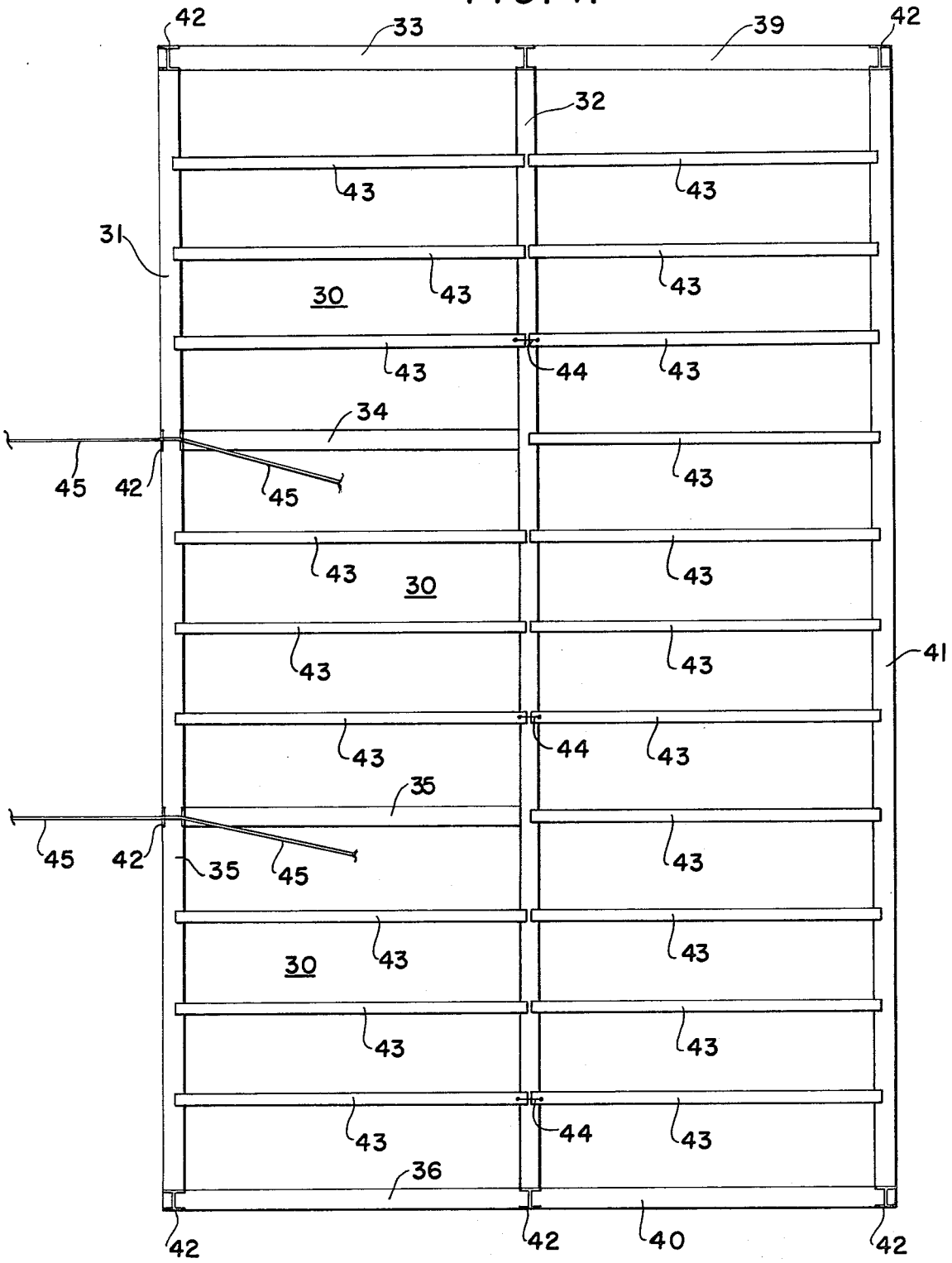
FIG. 4 is a diagrammatic plan view of an alternate form of the present invention utilizing guy wire or struts for lateral bracing of the structure.

The embodiment illustrated in FIG. 4 is preferably used in the construction of low-rise buildings - usually one or two stories. The grid structure of this representative portion of a larger structure is essentially the same as FIG. 1, except that guy wires or struts are employed instead of horizontal trusses to impart lateral bracing to the structure.

Figure 3:
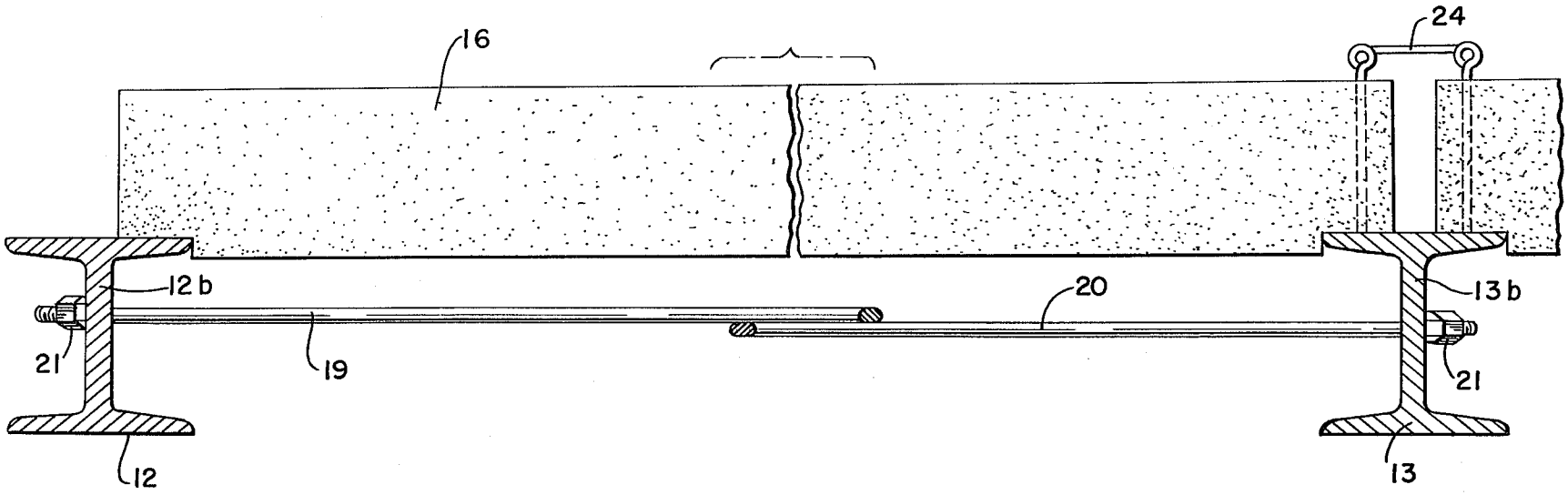
FIG. 3 is a cross-sectional view taken along line 3—3 of FIG. 2.

Several bays, designated generally by the numeral 30, are formed at one end of a structure. The bays are formed from a pair of generally horizontally disposed spaced, parallel girders 31 and 32, and a plurality of spaced beams 33, 34, 35 and 36 which extend transversely between the girders 31 and 32 and are connected thereto. Extending transversely outward from the bays is a larger unit formed by beams 39, 40 and 41. The beams and girders are secured to columns collectively identified as 42. Extending transversely to the end beams and girders are a plurality of end notched, precast concrete joists shown generally as 43, such as shown in FIG. 3, which fit securely over the compression flanges of the beams and girders. At selected intervals across the structure, lines of joists are tied together 44, to form continuous tension or compression ties to the bays. Securing the structure against lateral displacement are guy wires or struts 45 which are anchored to the ground and connected to the structure by any convenient means. The combined action of the guys, the end-notched concrete joists and the continuous tension ties substantially prevent lateral displacement or buckling of the girders under construction loads.

It should be understood that the combined action of the horizontal trusses and continuous ties is a preferred embodiment and that while the bays shown in the drawings are formed at the end portions of the various structures, they may also be formed at intermediate positions within the structure itself, for example, across the center of the structure.

The invention may be embodied in other specific forms without departing from the spirit or the essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A stable building structure comprising a plurality of horizontally disposed, spaced, structural members, each of said structural members being in an elevated position and secured to base supports; a series of spaced parallel beams extending transversely between adjacent pairs of said structural members and connected thereto so as to form a plurality of bays across a portion only of said structure, at least one truss member extending diagonally across each of said bays and means to connect the distal ends of said truss members to said adjacent pair of said structural members so as to form horizontal trusses; a plurality of parallel concrete joists supported by and transversely extending between said structural members, said joists being spaced from each other and from said parallel beams; each end portion of said joists engaging a structural member and adjacent end portions of said joists being tied together across said structural members or bonded to said structural members, so as to form continuous tension or compression ties which extend horizontally from said horizontal trusses across said building structure, including that portion of said building structure in which said bays have not been formed.

2. A structure as set forth in claim 1 wherein said joists are pre-cast concrete joists, the ends of which are notched so as to seat securely on said structural members.

3. A structure as set forth in claim 2 wherein said truss member is a cable or rod.

4. A structure as set forth in claim 1 comprising two truss members extending diagonally across each of said bays to connect opposing corners of said bays.

* * * * *